US010538116B2

(12) United States Patent
Lu

(10) Patent No.: US 10,538,116 B2
(45) Date of Patent: Jan. 21, 2020

(54) THERMAL TRANSFER PRINTER, COMPOSITE CONSUMABLE THEREOF AND METHOD FOR SUPPLYING SUCH COMPOSITE CONSUMABLE TO THERMAL TRANSFER PRINTER

(71) Applicant: Postek Electronics Co., Ltd, Shenzhen, Guangdong (CN)

(72) Inventor: Gaoren Lu, Guangdong (CN)

(73) Assignee: Postek Electronics Co., Ltd, Shenzhen (CN)

( * ) Notice: Subject to any disclaimer, the term of this patent is extended or adjusted under 35 U.S.C. 154(b) by 150 days.

(21) Appl. No.: 15/885,793

(22) Filed: Jan. 31, 2018

(65) Prior Publication Data

US 2019/0232698 A1 Aug. 1, 2019

(51) Int. Cl.

| | |
|---|---|
| ***B41J 31/10*** | (2006.01) |
| ***B41J 29/46*** | (2006.01) |
| ***B41J 2/325*** | (2006.01) |
| ***B41J 35/36*** | (2006.01) |

(52) U.S. Cl.

CPC ..... *B41J 31/10* (2013.01); *B41J 2/325* (2013.01); *B41J 29/46* (2013.01); *B41J 35/36* (2013.01)

(58) Field of Classification Search

CPC .... B65C 9/00; B65C 2009/0003; B41J 31/10; B41J 29/46; B41J 2/325

See application file for complete search history.

(56) References Cited

U.S. PATENT DOCUMENTS

| | | | | |
|---|---|---|---|---|
| 5,037,219 | A * | 8/1991 | Duport | G09F 3/02 400/241 |
| 5,587,214 | A * | 12/1996 | Mitchell, Jr. | B31D 1/027 40/638 |
| 6,249,301 | B1 * | 6/2001 | Kawamura | B41J 11/42 347/176 |
| 9,539,834 | B2 * | 1/2017 | Tanaka | B41J 17/02 |
| 2015/0082744 | A1 * | 3/2015 | Tanaka | B41J 17/02 53/131.5 |
| 2016/0275823 | A1 * | 9/2016 | Honda | G09F 3/02 |

FOREIGN PATENT DOCUMENTS

| | | | | |
|---|---|---|---|---|
| JP | 58022252 | * | 2/1983 | B41J 29/48 |
| JP | 01238971 | * | 9/1989 | B41J 15/16 |
| WO | WO 95/31800 | * | 11/1995 | B41M 5/38 |

* cited by examiner

*Primary Examiner* — Huan H Tran

(57) ABSTRACT

A thermal transfer printer and a composite consumable thereof and a method for supplying such composite consumable to the thermal transfer printer are disclosed. The consumable supplying device is installed with a composite consumable which is made by winding a thermal transfer ribbon and a printing media together around a common core with the ink side of the thermal transfer ribbon facing the surface of the printing media. Accordingly, just one consumable supplying device rather than two different consumable supplying devices as in existing thermal transfer printers should be arranged to provide the thermal transfer ribbon and the printing media to the thermal transfer printer at the same time. In such a way, the internal space of the thermal transfer printer can be effectively saved, which significantly reduces the volume of the thermal transfer printer.

13 Claims, 3 Drawing Sheets

THERMAL TRANSFER PRINTER, COMPOSITE CONSUMABLE THEREOF AND METHOD FOR SUPPLYING SUCH COMPOSITE CONSUMABLE TO THERMAL TRANSFER PRINTER

TECHNICAL FIELD

The present disclosure relates generally to the field of thermal transfer printer, and more particularly, to a thermal transfer printer and a composite consumable thereof and a method for supplying such composite consumable to the thermal transfer printer.

BACKGROUND

With characteristic of simple and convenient operation, stable performance, less maintenance work, flexible specifications and wide range of applications, the thermal transfer printer using thermal print heads becomes the mainstream printing equipment in the bar code/radio frequency identification (RFID) label printing, security sign printing and other fields.

The printer consumables used by the traditional thermal transfer printer comprise the thermal transfer ribbon and the printing media which may be plain paper or polymer paper. When both the thermal transfer ribbon and the printing media are transferred to the heating point of the printing head, due to the heating of the printing head the ink coating on the thermal transfer ribbon is melted and transferred to the printing media under the pressure of the printing head, such that the contents need to be printed are shown.

In the prior art, the thermal transfer printer is provided with separate supply devices for the thermal transfer ribbon and the printing media. Normally, the thermal transfer ribbon and the printing media are mounted in/on the printer ribbon box/shaft and the paper box/shaft in the form of ribbon rolls and paper rolls, respectively. Such that the thermal transfer ribbon and printing media can be produced separately with low production cost. At the same time it is very flexible to match the print media well with different kinds of thermal transfer ribbon in order to meet the printout quality requirements.

However, the thermal transfer printer with separate thermal transfer ribbon supply and printing media supply requires a large space for consumables installation, resulting in a large footprint for the printer. And the size matters much for handheld/mobile printers. At the same time, the consumables installation process for this type of printer is complex, thus giving poor user experiences.

SUMMERY

The object of the present application is to provide a thermal transfer printer, a composite consumable thereof and a method for supplying such composite consumable to the thermal transfer printer, aiming to address the problems in the prior art the thermal transfer printer with separate thermal transfer ribbon supply and printing media supply, which requires a large space for consumables installation, resulting in a large footprint for the printer, while the consumables installation process for this type of printer is complex, thus giving poor user experiences.

In one aspect, a thermal transfer printer according to one embodiment of the present application is provided which comprising:

a consumable supplying device installed with a composite consumable which is made by winding a thermal transfer ribbon and a printing media together around a common core with an ink side of the thermal transfer ribbon facing a surface of the printing media;

a thermal print head configured to heat an ink on the thermal transfer ribbon and to print heated ink onto the surface of the printing media;

a platen roller configured to drive the composite consumable to pass through a printing area of the thermal print head;

a motor configured to drive the platen roller to operate; and a printing control device respectively electrically connected with the thermal print head and the motor for controlling a printing of the thermal transfer printer.

Preferably, the thermal transfer printer according to the embodiment of the present application further comprises a torque limiter connected with the consumable supplying device for maintaining the composite consumable in a taut state when the composite consumable is supplied to the thermal print head by the consumable supplying device.

Preferably, the thermal transfer printer according to the embodiment of the present application further comprises a rotary mechanism connected with the consumable supplying device for controlling the consumable supplying device to rewind the composite consumable in the case when the composite consumable are fed back by the thermal transfer printer.

Preferably, the thermal transfer printer according to the embodiment of the present application further comprises:

a consumable usage monitoring sensor electrically connected with the printing control device for monitoring a remaining amount of the composite consumable in the consumable supplying device; and a low consumable alarm electrically connected with the printing control device for sending a warning signal to a user under the control of the printing control device when the consumable usage monitoring sensor monitors that the remaining amount of the composite consumable is less than a preset threshold.

Preferably, the thermal transfer printer according to the embodiment of the present application further comprises a RFID module and an antenna electrically connected with the RFID module, wherein the RFID module is further electrically connected with the printing control device to cooperate with a RFID tag chip installed on the composite consumable for reading an authentication information pre-stored in the RFID tag chip to verify a legality of the composite consumable before the composite consumable is supplied to the thermal transfer printer and for dynamically reading and writing a length information of the composite consumable to monitor and manage a length of the composite consumable after the legality of the composite consumable is verified.

In the thermal transfer printer according to the embodiment of the present application, the low consumable alarm is at least one selected from a group consisting of a liquid crystal display (LCD) screen, a light emitting diode (LED) indicator or a buzzer.

Preferably, the thermal transfer printer according to the embodiment of the present application further comprises a ribbon retrieval device configured to rewind used thermal transfer ribbon.

In another aspect, a method for supplying thermal transfer consumable applicable to the above thermal transfer printer is provided, which comprising:

installing a composite consumable onto a consumable supplying device of the thermal transfer printer, wherein the composite consumable is made by winding a thermal transfer ribbon and a printing media together around a common core with an ink side of the thermal transfer ribbon facing a surface of the printing media;

supplying the thermal transfer ribbon and the printing media to the thermal transfer printer at the same time via the consumable supplying device installed with the composite consumable.

In a further aspect, a composite consumable applicable to the above thermal transfer printer according to one embodiment of the present application is also provided, which is made by winding a thermal transfer ribbon and a printing media together around a common core with an ink side of the thermal transfer ribbon facing a surface of the printing media.

Preferably, in the composite consumable according to one embodiment of the present application, a free end of the thermal transfer ribbon is longer than a free end of the printing media.

Following technical effects can be obtained by the thermal transfer printer according to embodiments of the present application.

As the consumable supplying device is installed with a composite consumable which is made by winding the thermal transfer ribbon and the printing media together around a common core with the ink side of the thermal transfer ribbon facing the surface of the printing media, just one consumable supplying device rather than two different consumable supplying devices as in existing thermal transfer printers should be arranged to provide the thermal transfer ribbon and the printing media to the thermal transfer printer at the same time. In such a way, the internal space of the thermal transfer printer can be effectively saved, which significantly reduces the volume of the thermal transfer printer. At the same time, the thermal transfer printer is also significantly simplified for reducing the preparation cost, and the user's installation steps are also simplified for improving the user's experience.

BRIEF DESCRIPTION OF THE DRAWINGS

In order to more clearly illustrate the technical solution in the embodiments of the present application, the drawings to be used in the description of the embodiments will be briefly described below. It will be apparent that the drawings in the following description are merely exemplary of the application and that other drawings may be obtained by those skilled in the art without any inventive work.

DETAILED DESCRIPTION OF THE PREFERRED EMBODIMENT

In order to clarify the objects, technical solutions and advantages of the embodiments of the present application, the following detailed description will be made for the technical solution in the embodiments of the present application combining the drawings attached.

First Embodiment

Figure 1:
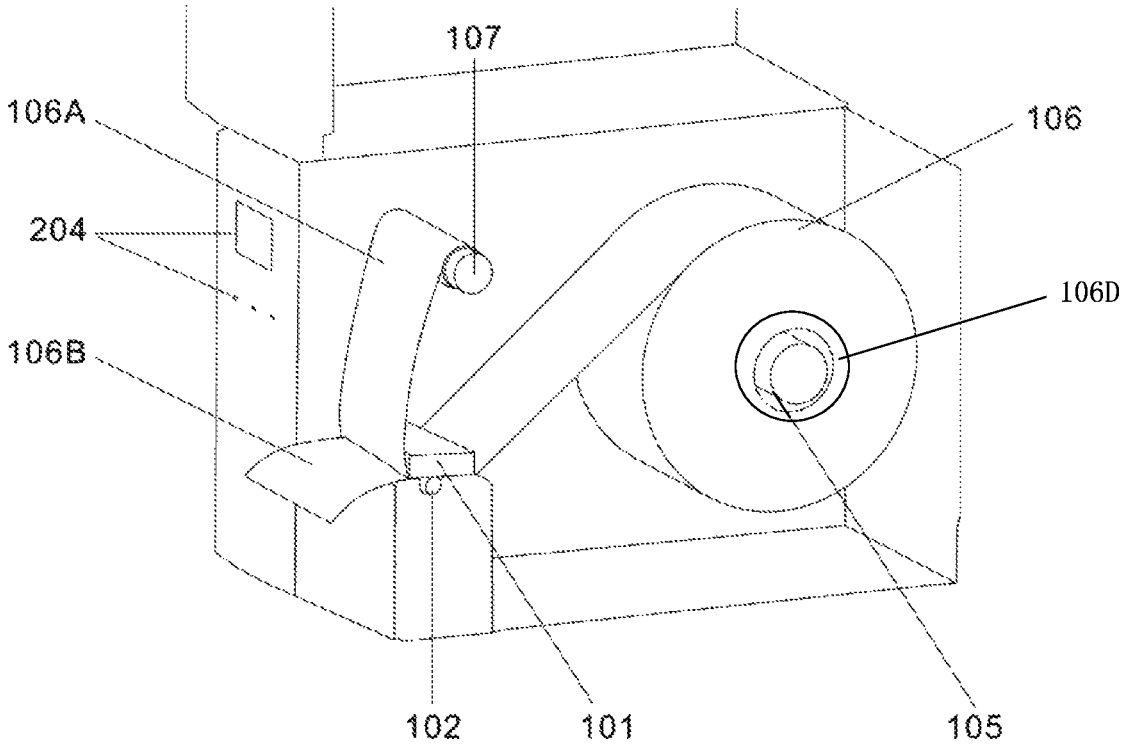
FIG. 1 is a schematic diagram of the thermal transfer printer provided by the first embodiment of the present application.

The embodiment of the present application provides a thermal transfer printer. Referring to FIG. 1, the thermal transfer printer comprises a consumable supplying device 105, a printing control device 104 (referring FIG. 2), a thermal print head 101, a platen roller 102, and a motor 103. The consumable supplying device 105 is used to install the composite consumable 106 which is made by winding the thermal transfer ribbon 106A and the printing media 106B together around a common core 106D with the ink side of the thermal transfer ribbon facing the surface of the printing media. In this way, when the user installs the composite consumable 106, both of the thermal transfer ribbon 106A and the printing media 106B can be added to the printer at the same time rather than being separately installed, thus reducing the complexity of printer consumables installation and bringing better experience for users. At the same time, just one consumable supplying device 105 is required to be set on the thermal transfer printer, which will satisfy the installation of the thermal transfer ribbon 106A and printing media 106B without setting two different consumable supply devices as that in the conventional printer. In such a way, the internal space of the thermal transfer printer can be effectively saved, which significantly reduces the volume of the thermal transfer printer.

The thermal print head 101 is configured to heat the ink on the thermal transfer ribbon 106A and to print heated ink onto the surface of the printing media 106B.

The platen roller 102 is configured to drive the composite consumable 106 to pass through the printing area of the thermal print head 101.

The motor 103 is configured to drive the platen roller 102 to operate.

The consumable supplying device 105 is provided with a roller on which the composite consumable 106 is sheathed. The consumable supplying device 105 and the composite consumable 106 are linked together, that is, when the composite consumable 106 is driven to feed by the platen roller 102, the roller of the consumable supplying device 105 is also rotated.

The printing control device 104 which is electrically connected with the thermal print head 101 and the motor 103 is configured to control the printing of the thermal transfer printer.

Figure 2:
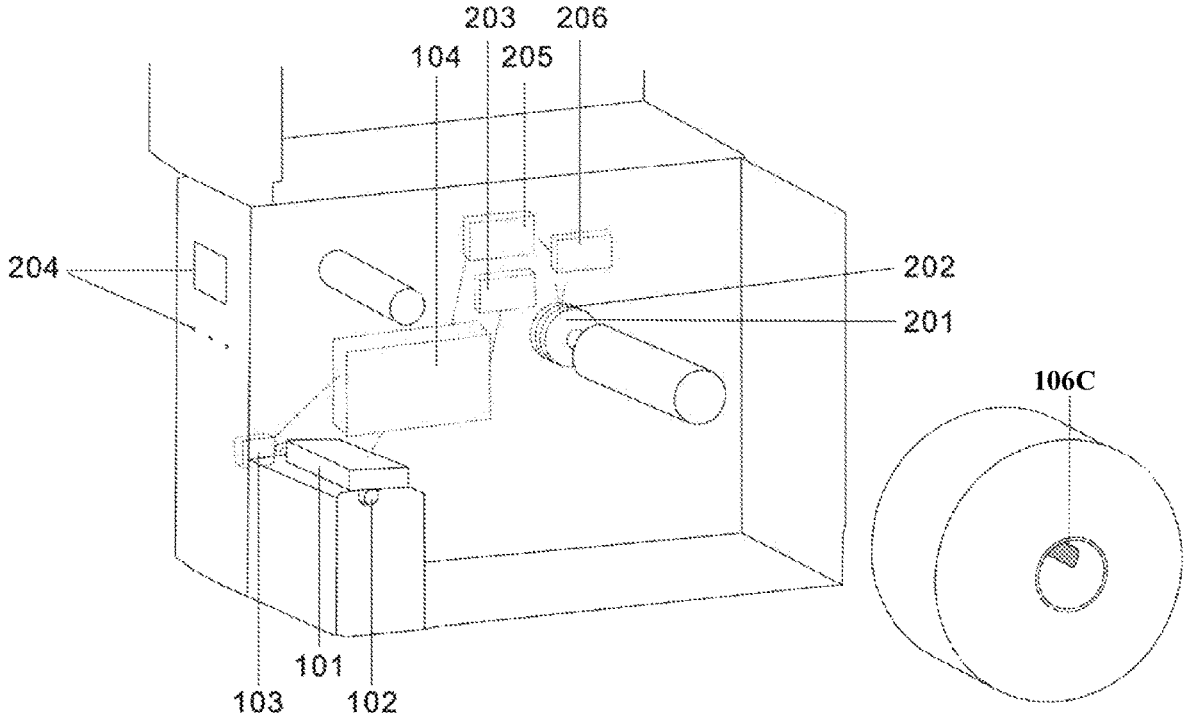
FIG. 2 is a schematic diagram of the thermal transfer printer provided by the first embodiment of the present application.

Specifically, referring to FIG. 2, the thermal transfer printer further comprises a torque limiter 201 connected with the roller of the consumable supplying device 105. The torque limiter 201 is configured to maintain the composite consumable 106 in a taut state when the composite consumable 106 is supplied to the thermal print head 101 by the consumable supplying device 105. In practical applications, the torque limiter 201 can adaptively adjust the rotating speed of the roller of the consumable supplying device 105, and can cooperate with the platen roller 102 to maintain the composite consumable 106 in the taut state, thus preventing the composite consumable 106 from wrinkling for affecting the printing effect.

Figure 3:
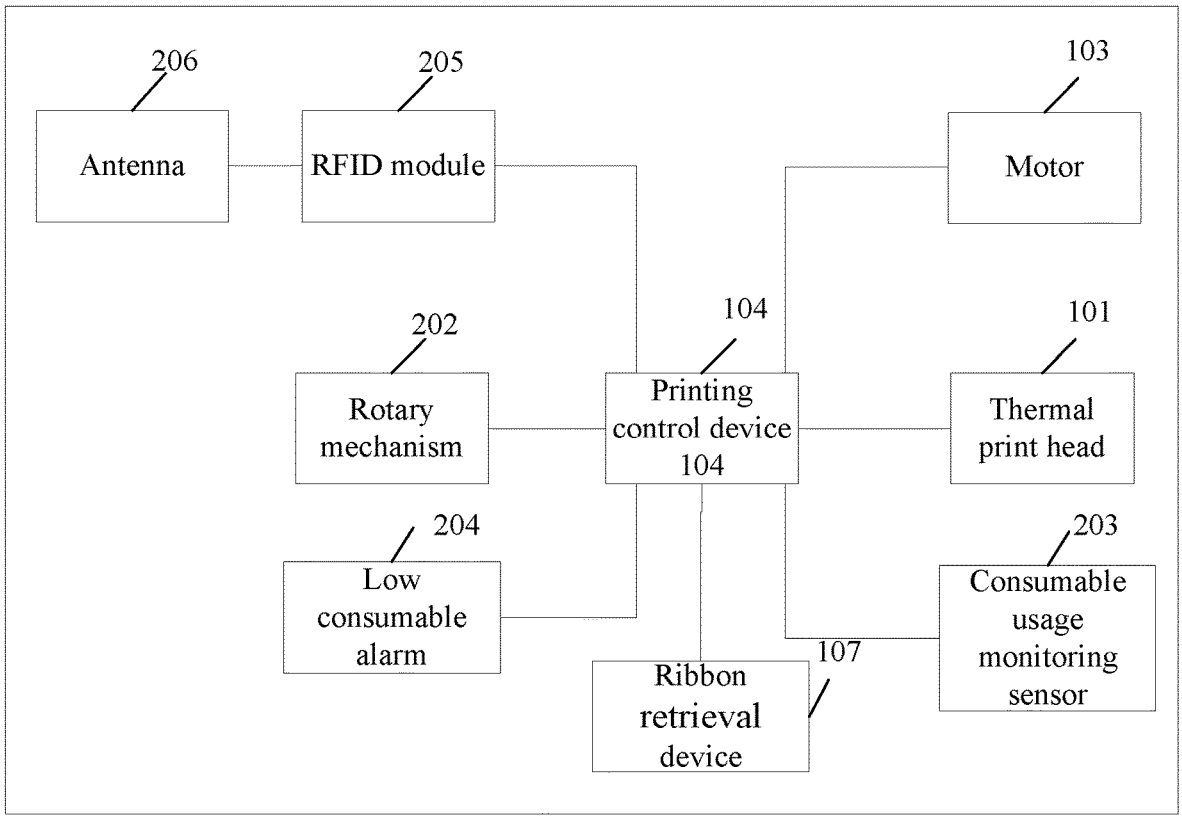
FIG. 3 is a schematic diagram of the circuit part of the thermal transfer printer provided by the first embodiment of the present application.

Furthermore, referring to FIG. 2 or FIG. 3, the thermal transfer printer further comprises a rotary mechanism 202 which is connected with the roller of the consumable supplying device 105 and electrically connected with the printing control device 104 for controlling the consumable supplying device 105 to rewind the composite consumable 106 in the case where the composite consumable 106 are fed back by the platen roller 102. In practical applications, the rotary mechanism 202 can control the consumable supplying device 105 to reverse (that is, contrary to the direction of rotation when the consumable supplying device 105 normally supplies the consumable). In the case when the composite consumable 106 are fed back by the thermal transfer printer, controlling the consumable supplying device 105 to rewind the composite consumable 106 can prevent the composite consumable 106 from ribbon wrinkling.

Specifically, referring to FIG. 2 and FIG. 3, the thermal transfer printer further comprises a consumable usage monitoring sensor 203 and a low consumable alarm 204. The consumable usage monitoring sensor 203 electrically connected with the printing control device 104 is configured to monitor a remaining amount of the composite consumable 106 in the consumable supplying device 105. The low consumable alarm 204 electrically connected with the printing control device 104 is configured to send a warning signal to a user under the control of the printing control device 104 when the consumable usage monitoring sensor 203 monitors that the remaining amount of the composite consumable 106 is less than a preset threshold.

In the present embodiment, by the corporation of the consumable usage monitoring sensor 203 and the low consumable alarm 204, the remaining amount (that is the remaining available length) of the composite consumable 106 in the thermal transfer printer can be monitored. Moreover, when the remaining amount is too small, the user is reminded to change the composite consumable 106 in time, which ensures the print fluency and enhances the user experience.

Further, referring to FIG. 2 or FIG. 3, the thermal transfer printer further comprise a RFID module 205 and an antenna 206 electrically connected with the RFID module 205. The RFID module 205 can be a high-frequency (HF) RFID module with a frequency around 13.56 MHz, or an ultra high-frequency (UHF) RFID module with a frequency in a range from 860 to 960 MHz. The RFID module 205 is electrically connected with the printing control device 104 to cooperate with a RFID tag chip 106C installed on the composite consumable 106 for reading an authentication information pre-stored in the RFID tag chip 106C to verify a legality of the composite consumable 106 before the composite consumable 106 is supplied to the thermal transfer printer and for dynamically reading and writing a length information of the composite consumable 106 to monitor and manage a length of the composite consumable 106 after the legality of the composite consumable 106 is verified.

In the present embodiment, a RFID tag chip 106C may be specifically affixed to the composite consumable 106. The RFID tag ID, the authentication information and the length information of the composite consumable 106 are recorded in the RFID tag chip 106C, wherein the authentication information is obtained by a specific encryption algorithm based on the ID of the RFID tag. This encryption algorithm can be a pre-stored firmware program in the printing control device 104. After reading the ID and the authentication information of the RFID tag in the RFID tag chip 106C, the RFID module 205 will transfer the ID and the authentication information of the RFID tag to the printing control device 104. Then the authentication information is resolved by the printing control device 104 via the encryption algorithm. The match degree between the resolved authentication information and the ID of the RFID tag are verified. If they are successfully matched with each other, the composite consumable 106 is verified, that is the legality of the composite consumable 106 is verified, or else the composite consumable 106 is not verified. If a composite consumable 106 which fails the verifying is placed in the consumable supplying device 105, the thermal transfer printer will not start to print, in such a way the specificity of consumables can be guaranteed. After the legality of the composite consumable 106 is verified, the RFID module 205 will dynamically read the length information of the composite consumable 106. If the length of the composite consumable 106 is found to be smaller than the default value, a warning signal for changing the consumable is sent to the user by the low consumable alarm 204. If the length of the composite consumable 106 is larger than the default value, the thermal transfer printer can start to print. Moreover, at the end of each print job, the length information of the composite consumable 106 will be rewritten into the RFID tag chip 106C by the RFID module 205. Meanwhile the length information in the RFID tag chip 106C is updated in real time for monitoring and managing the length of the composite consumable 106.

Further, the low consumable alarm 204 can be at least one selected from a group consisting of an LCD panel, an LED indicator, or a buzzer. In this way the low consumable alarm 204 can remind the user through the form of sound and light, etc., so that the user can replace the composite consumable 106 in time.

Further, referring to FIG. 1 or FIG. 3, the thermal transfer printer further comprises a ribbon retrieval device 107 configured to rewind the used thermal transfer ribbon 106A. Specifically, the ribbon retrieval device 107 comprises a spindle. The free end of the thermal transfer ribbon 106A is winded on the electric spindle such that the used thermal transfer ribbon 106A can be rewound by the rotation of the spindle of the ribbon retrieval device 107. It is worth mentioning that, the free end of the thermal transfer ribbon 106A is longer than the free end of the printing media 106B, so that the thermal transfer ribbon 106A is preliminarily wound around the ribbon retrieval device 107. Meanwhile the printing media 106B can be saved.

In the embodiment of the present application, As the consumable supplying device is installed with a composite consumable which is made by winding the thermal transfer ribbon and the printing media together around a common core with the ink side of the thermal transfer ribbon facing the surface of the printing media, just one consumable supplying device rather than two different consumable supplying devices as in existing thermal transfer printers should be arranged to provide the thermal transfer ribbon and the printing media to the thermal transfer printer at the same time. In such a way, the internal space of the thermal transfer printer can be effectively saved, which significantly reduces the volume of the thermal transfer printer. At the same time, the thermal transfer printer is also significantly simplified for reducing the preparation cost, and the user's installation steps are also simplified for improving the user's experience.

Second Embodiment

Figure 4:
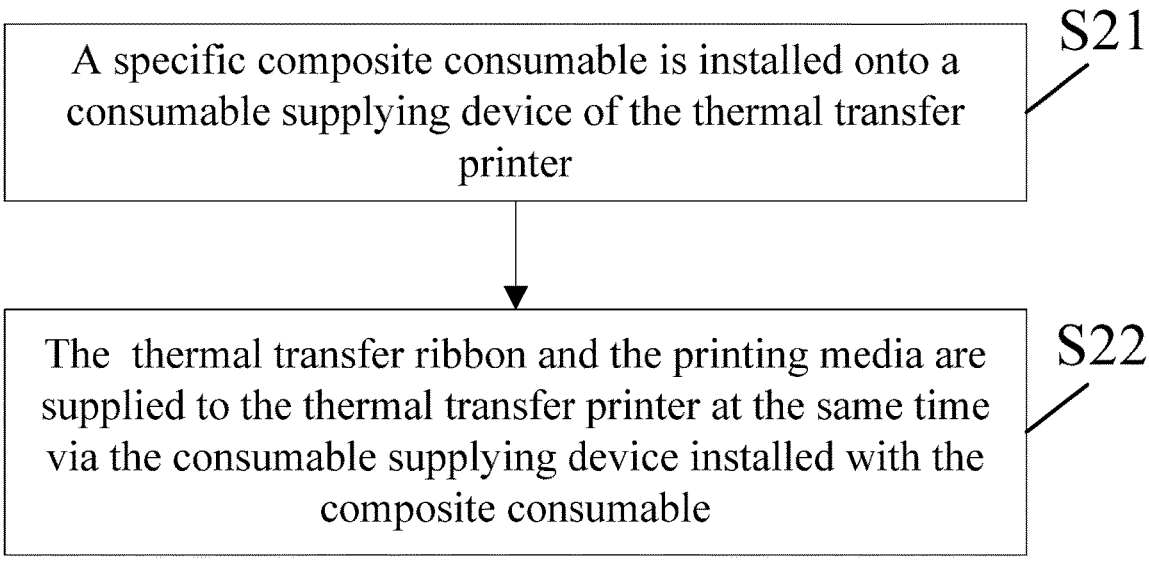
FIG. 4 is a flow chart of the method for supplying thermal transfer consumable provided by the second embodiment of the present application.

The embodiment of the present application provides a method for supplying thermal transfer consumable applicable to the above thermal transfer printer of the first embodiment. Referring to FIG. 4, the method comprises following steps.

In step S21, a specific composite consumable is installed onto a consumable supplying device of the thermal transfer printer. In the present step S21, the composite consumable is made by winding the thermal transfer ribbon and the printing media together around a common core with the ink side of the thermal transfer ribbon facing the surface of the printing media.

In the present embodiment, the specific composite consumable is installed to a consumable supplying device. The composite consumable is made by winding the thermal transfer ribbon and the printing media together around a common core with the ink side of the thermal transfer ribbon facing the surface of the printing media. In this way, when the user installs the composite consumable, the thermal transfer ribbon and the printing media be added to the printer at the same time rather than being separately installed, thus reducing the complexity of printer consumables installation and bringing better experience for users.

In Step S22, the thermal transfer ribbon and the printing media are supplied to the thermal transfer printer at the same time via the consumable supplying device installed with the composite consumable.

In the present embodiment, just one consumable supplying device is required to supply the thermal transfer ribbon and printing media for the thermal transfer printer. In such a way, the internal space of the thermal transfer printer can be effectively saved, which significantly reduces the volume of the thermal transfer printer.

In the embodiment of the present application, As the consumable supplying device is installed with a composite consumable which is made by winding the thermal transfer ribbon and the printing media together around a common core with the ink side of the thermal transfer ribbon facing the surface of the printing media, just one consumable supplying device rather than two different consumable supplying devices as in existing thermal transfer printers should be arranged to provide the thermal transfer ribbon and the printing media to the thermal transfer printer at the same time. In such a way, the internal space of the thermal transfer printer can be effectively saved, which significantly reduces the volume of the thermal transfer printer. At the same time, the thermal transfer printer is also significantly simplified for reducing the preparation cost, and the user's installation steps are also simplified for improving the user's experience.

Third Embodiment

The embodiment of the present application provides a composite consumable 106. Referring back to FIG. 1, the composite consumable 106 is made by winding the thermal transfer ribbon 106A and the printing media 106B together around a common core with the ink side of the thermal transfer ribbon 106A facing the surface of the printing media 106B. In the present embodiment, the free end of the thermal transfer ribbon 106A is longer than the free end of the printing media 106B, so that the thermal transfer ribbon 106A is preliminarily wound around the ribbon retrieval device 107. Meanwhile the printing media 106B can be saved.

In the embodiment of the present application, As the consumable supplying device is installed with a composite consumable which is made by winding the thermal transfer ribbon and the printing media together around a common core with the ink side of the thermal transfer ribbon facing the surface of the printing media, just one consumable supplying device rather than two different consumable supplying devices as in existing thermal transfer printers should be arranged to provide the thermal transfer ribbon and the printing media to the thermal transfer printer at the same time. In such a way, the internal space of the thermal transfer printer can be effectively saved, which significantly reduces the volume of the thermal transfer printer. At the same time, the thermal transfer printer is also significantly simplified for reducing the preparation cost, and the user's installation steps are also simplified for improving the user's experience.

The embodiment number of the invention described above is only for description, and does not mean the advantages and disadvantages of the embodiment.

The foregoing is intended only as a preferred embodiment of the invention and is not intended to limit the invention, and any modifications made within the spirit and principles of the invention, equivalents, modifications, etc., are intended to be encompassed by the invention within the range.

The invention clamed is:

1. A thermal transfer printer comprising:

a consumable supplying device installed with a composite consumable which is made by winding a thermal transfer ribbon and a printing media together around a common core with an ink side of the thermal transfer ribbon facing a surface of the printing media;

a thermal print head configured to heat an ink on the thermal transfer ribbon and to print heated ink onto the surface of the printing media;

a platen roller configured to drive the composite consumable to pass through a printing area of the thermal print head;

a motor configured to drive the platen roller to operate;

a printing control device respectively electrically connected with the thermal print head and the motor for controlling a printing of the thermal transfer printer;

a RFID module and an antenna electrically connected with the RFID module, wherein the RFID module is further electrically connected with the printing control device to cooperate with a RFID tag chip installed on the composite consumable for reading an authentication information pre-stored in the RFID tag chip to verify a legality of the composite consumable before the composite consumable is supplied to the thermal transfer printer and for dynamically reading and writing a length information of the composite consumable to monitor and manage a length of the composite consumable after the legality of the composite consumable is verified.

2. The thermal transfer printer according to claim 1, wherein further comprising a torque limiter connected with the consumable supplying device for maintaining the composite consumable in a taut state when the composite consumable is supplied to the thermal print head by the consumable supplying device.

3. The thermal transfer printer according to claim 2, wherein further comprising a rotary mechanism connected with the consumable supplying device for controlling the consumable supplying device to rewind the composite consumable in the case when the composite consumable are fed back by the thermal transfer printer.

4. The thermal transfer printer according to claim 3, wherein further comprising a ribbon retrieval device configured to rewind used thermal transfer ribbon.

5. The thermal transfer printer according to claim 2, wherein further comprising a ribbon retrieval device configured to rewind used thermal transfer ribbon.

6. The thermal transfer printer according to claim 1, wherein further comprising:

a consumable usage monitoring sensor electrically connected with the printing control device for monitoring a remaining amount of the composite consumable in the consumable supplying device; and a low consumable alarm electrically connected with the printing control device for sending a warning signal to a user under the control of the printing control device when the consumable usage monitoring sensor monitors that the remaining amount of the composite consumable is less than a preset threshold.

7. The thermal transfer printer according to claim 6, wherein the low consumable alarm is at least one selected from a group consisting of a liquid crystal display screen, a light emitting diode indicator or a buzzer.

8. The thermal transfer printer according to claim 7, wherein further comprising a ribbon retrieval device configured to rewind used thermal transfer ribbon.

9. The thermal transfer printer according to claim 6, wherein further comprising a ribbon retrieval device configured to rewind used thermal transfer ribbon.

10. The thermal transfer printer according to claim 1, wherein further comprising a ribbon retrieval device configured to rewind used thermal transfer ribbon.

11. The thermal transfer printer according to claim 1, wherein a free end of the thermal transfer ribbon is longer than a free end of the printing media.

12. A method for supplying thermal transfer consumable applicable to a thermal transfer printer comprising:

installing a composite consumable onto a consumable supplying device of the thermal transfer printer, wherein the composite consumable is made by winding a thermal transfer ribbon and a printing media together around a common core with an ink side of the thermal transfer ribbon facing a surface of the printing media;

supplying the thermal transfer ribbon and the printing media to the thermal transfer printer at the same time via the consumable supplying device installed with the composite consumable;

wherein the thermal transfer printer comprises:

the consumable supplying device installed with the composite consumable, wherein the consumable supplying device and the composite consumable are linked together;

a thermal print head configured to heat an ink on the thermal transfer ribbon and to print heated ink onto the surface of the printing media;

a platen roller configured to drive the composite consumable to pass through a printing area of the thermal print head;

a motor configured to drive the platen roller to operate; and a printing control device respectively electrically connected with the thermal print head and the motor for controlling a printing of the thermal transfer printer;

a RFID module and an antenna electrically connected with the RFID module, wherein the RFID module is further electrically connected with the printing control device to cooperate with a RFID tag chip installed on the composite consumable for reading an authentication information pre-stored in the RFID tag chip to verify a legality of the composite consumable before the composite consumable is supplied to the thermal transfer printer and for dynamically reading and writing a length information of the composite consumable to monitor and manage a length of the composite consumable after the legality of the composite consumable is verified.

13. A composite consumable made by winding a thermal transfer ribbon and a printing media together around a common core with an ink side of the thermal transfer ribbon facing a surface of the printing media;

wherein the composite consumable is applicable to a thermal transfer printer comprising:

a consumable supplying device installed with the composite consumable wherein the consumable supplying device and the composite consumable are linked together;

a thermal print head configured to heat an ink on the thermal transfer ribbon and to print heated ink onto the surface of the printing media;

a platen roller configured to drive the composite consumable to pass through a printing area of the thermal print head;

a motor configured to drive the platen roller to operate; and a printing control device respectively electrically connected with the thermal print head and the motor for controlling a printing of the thermal transfer printer;

wherein a free end of the thermal transfer ribbon is longer than a free end of the printing media.

* * * * *